US007031646B2

(12) United States Patent
Yasukawa et al.

(10) Patent No.: US 7,031,646 B2
(45) Date of Patent: Apr. 18, 2006

(54) DEVELOPING DEVICE

(75) Inventors: Shinji Yasukawa, Nagano (JP); Nobuhiro Miyakawa, Nagano (JP); Hiroshi Toyama, Nagano (JP); Takeshi Kobayashi, Nagano (JP); Shoji Hiruta, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/956,355

(22) Filed: Sep. 30, 2004

(65) Prior Publication Data

US 2005/0095040 A1 May 5, 2005

(30) Foreign Application Priority Data

Oct. 3, 2003 (JP) ..... P2003-345481

(51) Int. Cl.
*G03G 15/08* (2006.01)

(52) U.S. Cl. ..... 399/281; 399/285

(58) Field of Classification Search ..... 399/285, 399/281

See application file for complete search history.

(56) References Cited

U.S. PATENT DOCUMENTS 5,270,786 A * 12/1993 Kikuchi et al. ..... 399/286
5,689,784 A * 11/1997 Shin et al. ..... 399/285
6,026,265 A * 2/2000 Kinoshita et al. ..... 399/281
6,327,451 B1 * 12/2001 Mizuno ..... 399/281

FOREIGN PATENT DOCUMENTS

| | | |
|---|---|---|
| JP | 05-158340 | 6/1993 |
| JP | 09-244481 | 9/1997 |
| JP | 2001-051494 | 2/2001 |
| JP | 2002-072639 | 3/2002 |

* cited by examiner

*Primary Examiner*—Michael Tokar
*Assistant Examiner*—Crystal Wagner
(74) *Attorney, Agent, or Firm*—Hogan & Hartson, L.L.P.

(57) ABSTRACT

An electrostatic latent image is formed on an image carrier. A first roller is opposed to the image carrier with a gap in between. A second roller is in contact with the first roller such that toner of a one-component type is supplied onto the image carrier by way of the first roller to develop the electrostatic latent image as a visible toner image. A single power source supplies a bias voltage in which an AC voltage is superposed on a DC bias voltage. The bias voltage is supplied to the first roller through a first path and to the second roller through a second path. A resistor is provided on the first path between the first roller and a branching point of the first path and the second path.

8 Claims, 8 Drawing Sheets

FIG. 6A
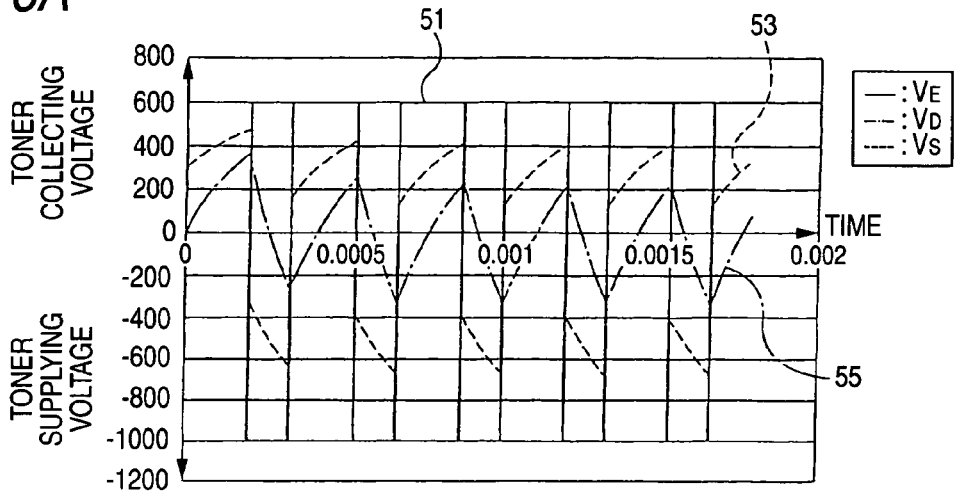
FIG. 6B
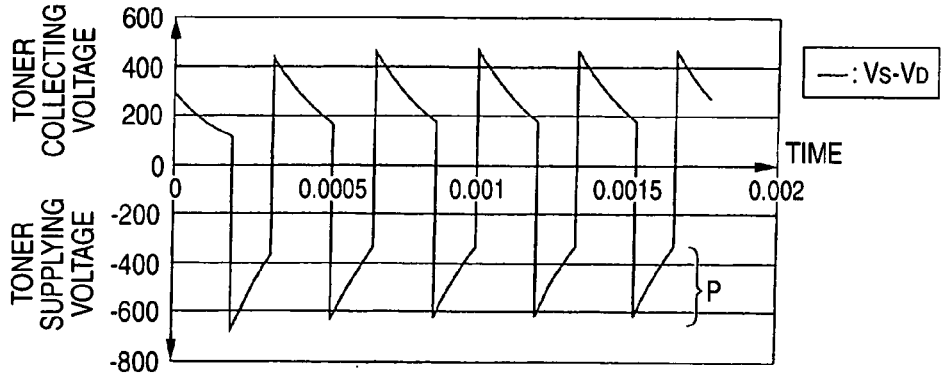
FIG. 6C
| ADDITIONAL RESISTANCE (Ω) | 10K | 100K | 1M | 10M |
|---|---|---|---|---|
| AVERAGE VOLTAGE (V) | -8 | -74 | -375 | -460 |
| MAXIMUM AMPLITUDE OF $V_D$ (V) | 1600 | 1600 | 1167 | 571 |

DEVELOPING DEVICE

BACKGROUND OF THE INVENTION

The present invention relates to a developing device that develops a latent image formed on a photosensitive body (image carrier) with toner.

Japanese Patent Publication No. 5-158340A discloses an electrophotographic developing device of a contact and one component type. This developing device includes a developing roller placed rotatably while being kept in contact with an image carrier, and a supply roller placed rotatably in the same direction as the developing roller while being kept in contact with the developing roller. The developing device also includes a bias power supply, comprising resistance and a DC power supply for applying a predetermined bias voltage to the developing roller and the supply roller. The resistance is provided between the power supply and a current path branch for the developing roller and the supply roller.

It is also known a developing device of a jumping development type in which a jumping phenomenon of toner is induced by applying an AC superimposed bias voltage, in which an AC voltage is superimposed on a bias DC voltage, while the developing roller is kept in a non-contact state with respect to the image carrier. It is possible to provide individual power supplies for the developing roller and the supply roller in such a non-contact type developing device. However, in order to save the manufacturing costs, it is preferable to apply an AC superimposed bias from a single power supply to the developing roller and the supply roller as in the configuration disclosed in the above publication.

In such a case, there are provided: a first circuit originated from the power supply and returned to the power supply by way of the image carrier and the developing roller; and a second circuit originated from the power supply and returned to the power supply by way of the image carrier, the developing roller, and the supply roller. Here, a resistance value in the second circuit becomes larger than that in the first circuit by a sum of actual resistance of the supply roller and contact resistance between the supply roller and the developing roller via toner. This lessens a current flowing from the developing roller to the power supply by way of the supply roller in the second circuit in comparison with a current flowing from the developing roller to the power supply in the first circuit. It is thus difficult for negatively charged toner to move from the supply roller to the developing roller, and the toner supplying property is thereby deteriorated.

SUMMARY OF THE INVENTION

It is therefore an object of the invention to provide a developing device of a non-contact type using a single power supply for applying an AC superimposed bias, which is capable of stably supplying toner from the supply roller to the developing roller, thereby reliably developing a latent image on an image carrier as a visible toner image.

In order to achieve the above object, according to the invention, there is provided a developing device, comprising:

an image carrier, on which an electrostatic latent image is formed;

a first roller, opposed to the image carrier with a gap in between;

a second roller, being in contact with the first roller such that toner of a one-component type is supplied onto the image carrier by way of the first roller to develop the electrostatic latent image as a visible toner image;

a single power source, which supplies a bias voltage in which an AC voltage is superposed on a DC bias voltage, the bias voltage being supplied to the first roller through a first path and to the second roller through a second path; and a resistor, provided on the first path between the first roller and a branching point of the first path and the second path.

With this configuration, since the current flowing through the second path is increased, the toner is stably and reliably supplied from the second roller to the first roller.

Preferably, a resistance of the second roller is greater than the a resistance of the first roller.

Preferably, a current flowing through the second path is greater than a current flowing through the first path. In this case, the suppliability of toner from the second roller to the first roller can be enhanced.

Preferably, the power source is a constant-voltage power source. In this case, a potential difference between the first roller and the second roller can be made stable against external noises.

Preferably, the second roller is an electron-conductive. In this case, since the resistance of the second roller is reduced, the suppliability of toner from the second roller to the first roller can be enhanced.

Preferably, the resistor has such a value that a potential difference between the first roller and the second roller converges on a reference value (e.g., zero) within a time period during which a potential difference between the first roller and the image carrier is such a value that charged toner is supplied from the first roller to the image carrier.

In this case, an entire resistance of the system including the first roller, the second roller and the resistor will not become so high, thereby the toner suppliability from the first roller to the image carrier can be maintained. Accordingly, in a case where such a developing device is incorporated in a laser printer or the like, high-quality image formation can be attained.

According to the invention, there is also provided a developing device, comprising:

an image carrier, on which an electrostatic latent image is formed;

a first roller, opposed to the image carrier;

a second roller, being in contact with the first roller such that toner is supplied onto the image carrier by way of the first roller to develop the electrostatic latent image as a visible toner image;

a single power source, which supplies a bias voltage to the first roller through a first path and to the second roller through a second path; and a resistor, provided on the first path between the first roller and a branching point of the first path and the second path.

BRIEF DESCRIPTION OF THE DRAWINGS

The above objects and advantages of the present invention will become more apparent by describing in detail preferred exemplary embodiments thereof with reference to the accompanying drawings, wherein:

FIG. 6A is a graph showing changes of potentials at essential points in the developing device of the invention;

FIG. 6B is a graph showing a change in a potential difference between the supply roller and the developing roller in the developing device of the invention;

FIG. 6C is a table showing essential valued for assessing the developing property and the supplying property, in connection with the resistance value of the additional resistor;

DETAILED DESCRIPTION OF THE INVENTION

Figure 1:
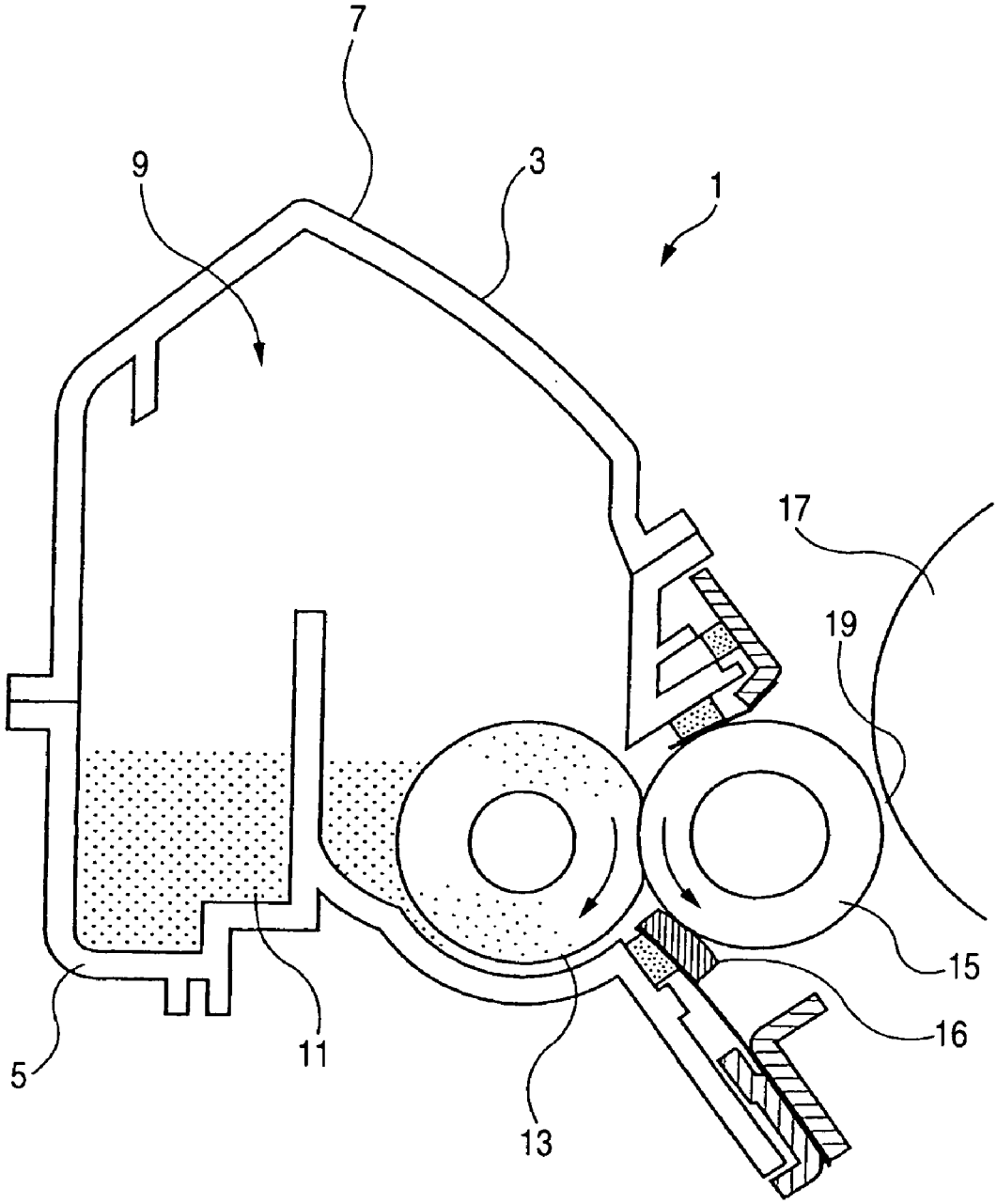
FIG. 1 is a section view of a developing cartridge to which the invention is applied.

Embodiments of the invention will be described below in detail with reference to the accompanying drawings. FIG. 1 shows a developing cartridge 1 incorporated for use in a laser printer that incorporates a developing device of the invention. In the developing cartridge 1 is formed a housing 7 comprising an upper housing member 3 and a lower housing member 5 that are combined integrally. Inside the housing 7 is formed a toner storage 9 to accommodate toner. The toner storage 9 is provided with a plurality of agitation blades (not shown) to agitate toner 11.

Also, a supply roller 13 whose surface is made of urethane sponge is placed in the toner storage 9 in a rotatable manner. The supply roller 13 preferably has electron conductivity. A developing roller 15 is placed on the outside of the supply roller 13 while being kept in contact with the supply roller 13. Hence, when the supply roller 13, carrying toner 11 accommodated in the housing 7 on its surface, rotates in a direction indicated by an arrow, the developing roller 15 rotates in a direction indicated by an arrow at the same velocity as the supply roller 13 while receiving the toner 11 on its outer peripheral surface from the supply roller 13.

A control blade 16 is kept pressed against the peripheral surface of the developing roller 15. The control blade 16 is provided with a function of charging the toner 11 to the same polarity through friction as well as a function of leveling the toner 11 adhering to the peripheral surface of the developing roller 15 to achieve, for example, a final thickness on the order of 20 μm.

A photosensitive drum 17 serving as a image carrier is provided while being spaced apart slightly from the surface of the developing roller 15. The photosensitive drum 17 is charged by a charger (not shown), and it is thus possible to form an electrostatic latent image on the photosensitive drum 17 through exposure with a laser beam emitted from an exposer and scanned over the outer peripheral surface of the photosensitive drum 17. The toner 11 moves from the supply roller 13 to the surface of the developing roller 15 by a bias potential difference to form a toner layer of a predetermined thickness. By the bias potential difference and at a developing position 19, the toner 11 carried by developing roller 15 in this manner jumps onto the surface of the photosensitive drum 17 on which an electrostatic latent image is formed, and the latent image on the photosensitive drum 17 is thereby developed.

Figure 2A:
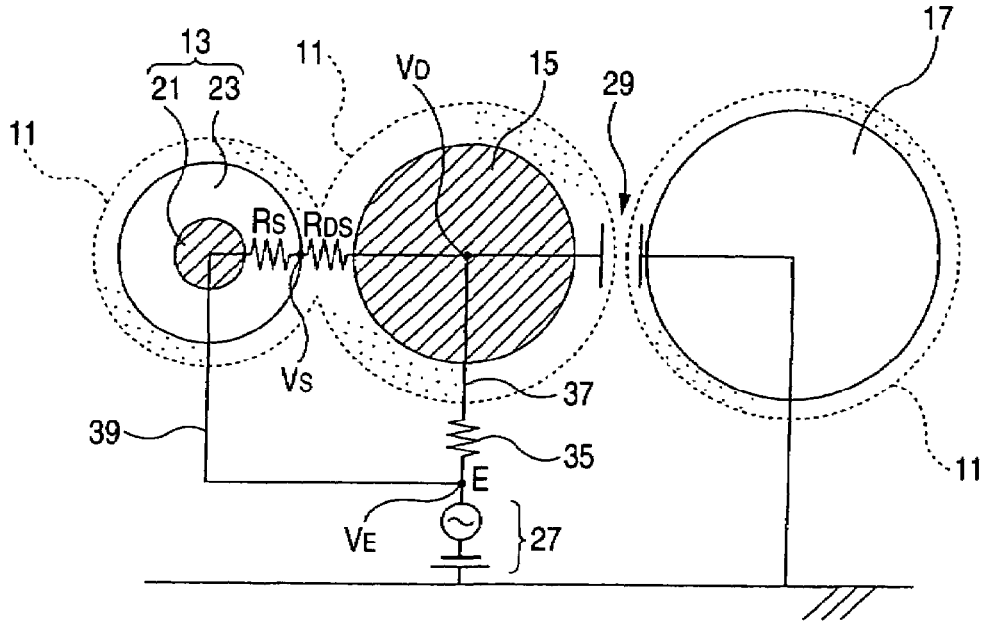
FIG. 2A is a schematic view of a developing device according to a first embodiment of the invention.

According to a first embodiment shown in FIG. 2A, the supply roller 13 comprises a core material 21 made of metal (for example, aluminum) and an elastic layer 23 formed on the periphery thereof, while the entire developing roller 15 is made of metal (for example, aluminum). In an equivalent circuit superposingly shown in this figure, $R_S$ denotes resistance of the elastic layer 23, and $R_{DS}$ denotes contact resistance between the supply roller 13 and the developing roller 15 via the toner 11. The inner side of a circle indicated by dashed lines drawn in the outermost periphery of each of the supply roller 13, the developing roller 15, and the photosensitive drum 17 denotes a region where the toner 11 adheres.

In this embodiment, a bias voltage is applied to both the supply roller 13 and the developing roller 15 from a single bias power supply 27. The bias power supply 27 is adapted to apply an AC superposed bias voltage in which an AC voltage is superimposed on a bias DC voltage. The bias power supply 27 is preferably a constant voltage power supply. In the equivalent circuit, a point at which the line from the bias power supply 27 branches to the supply roller 13 and the developing roller 15 is denoted as a branching point E.

The developing roller 15 is spaced apart from the photosensitive drum 17. When the polarities of the DC bias voltage and the AC superposed voltage are matched, a current flows from the photosensitive drum 17 to the developing roller 15. In this instance, the negatively charged toner 11 adhering onto the surface of the developing roller 15 jumps and adheres onto the surface of the photosensitive drum 17 by a bias potential difference. This phenomenon is represented as a capacitor 29 in the equivalent circuit. Meanwhile, when the polarities are not matched, a current flows from the developing roller 15 to the photosensitive drum 17. Extra toner that has not been used for the development on the photosensitive drum 17 is thus collected to the developing roller 15.

Figure 2B:
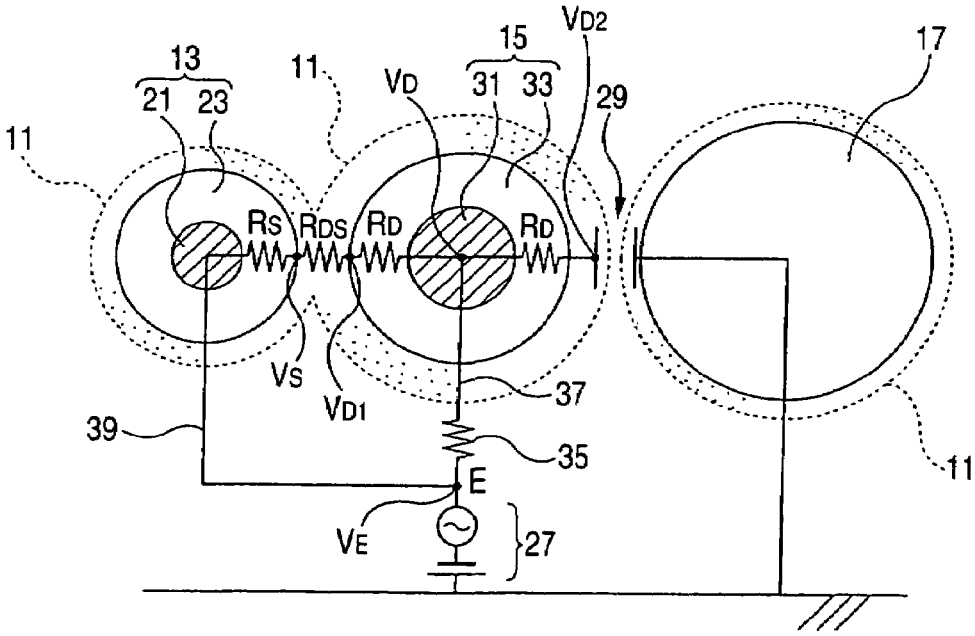
FIG. 2B is a schematic view of a developing device according to a second embodiment of the invention.

According to a second embodiment shown in FIG. 2B, the supply roller 13 is of the same structure as in the first embodiment, while the developing roller 15 comprises a core material 31 made of metal (for example, aluminum) and a rubber layer 33 formed on the periphery thereof. In an equivalent circuit superposingly shown in this figure, $R_S$ and $R_{DS}$ are the same as those of FIG. 2A, and $R_D$ denotes resistance of the rubber layer 33 of the developing roller 15. Because the rubber layer 33 is positioned on the both sides of the developing roller 15 in a radial direction along a current flow, the equivalent circuit is shown on the assumption that the developing roller 15 has a resistance of $2R_D$. Any other configurations are the same as in the first embodiment, and the repetitive explanations for those will be omitted.

In these embodiments, an additional resistor 35 is provided between the branching point E and the developing roller 15. In the equivalent parallel circuit comprising: a first current path 37 connecting the developing roller 15 and the branching point E; and a second current path 39 in which the developing roller 15 is connected to the branching point E by way of the supply roller 13, by interposing the additional resistor 35 on the first current path 37, a current that otherwise does not flow readily toward the second current path 39 is allowed to flow with ease. The negatively charged toner 11 is thus supplied readily from the supply roller 13 to the developing roller 15.

Figure 3:
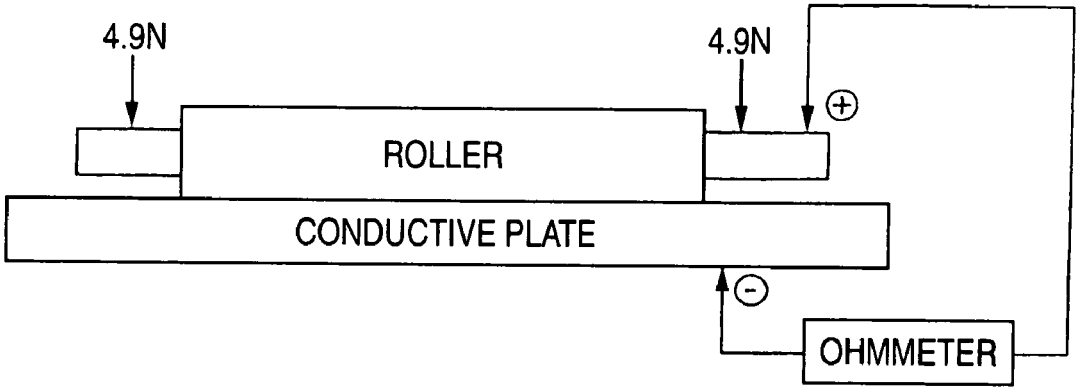
FIG. 3 is a schematic view for explaining a method of measuring a resistance of an elastic layer of a supply roller and a resistance of a rubber layer of a developing roller individually.

A method of determining a resistance value of such an additional resistor 35 will now be described. In FIGS. 2A and 2B, $V_E$ denotes a voltage at the branching point E, $V_S$ denotes a voltage on the surface of the supply roller 13, and $V_D$ denotes a voltage of the core material 31 of the developing roller 15. FIG. 3 shows a method of individually measuring resistance $R_S$ of the elastic layer 23 of the supply roller 13 and resistance $R_D$ of the rubber layer 33 of the developing roller 15 in the developing device of FIG. 2B. The resistance $R_S$ of the developing device of FIG. 2A can be measured by the same method. In this method, with the aim at stabilizing a measured value, measurement is performed after the application of 100 V of a DC voltage for one minute. Although it is not shown in the drawing, it is possible to find a sum of $R_S$ and $R_{DS}$ in the first embodiment and a sum of $R_S$, $R_D$, and $R_{DS}$ in the second embodiment by bringing a probe into contact with somewhere between metal shafts of the respective rollers in an actual use state with the toner being supplied to the surfaces.

Neither $R_S$ nor $R_D$ found by the method of FIG. 3 can be used directly when finding a sum of $R_S$ and $R_{DS}$ or a sum of $R_S$, $R_D$, and $R_{DS}$. However, when the measured value as to $R_D$ in the developing device (which is given as first $R_D$) is known, optimal $R_D$ can be found by actually performing printing with the developing device to check a resulting image quality, and then performing printing after the first $R_D$ is changed to another second $R_D$ to compare the resulting image qualities in judging whether $R_D$ should be increased or decreased. The measured results of $R_S$ and $R_D$ were 70 MΩ and 40 MΩ, respectively. The dispersed range of the measured values of $R_S$ and $R_D$ according to samples were 40–70 MΩ and 40–90 MΩ, respectively.

Figure 4:
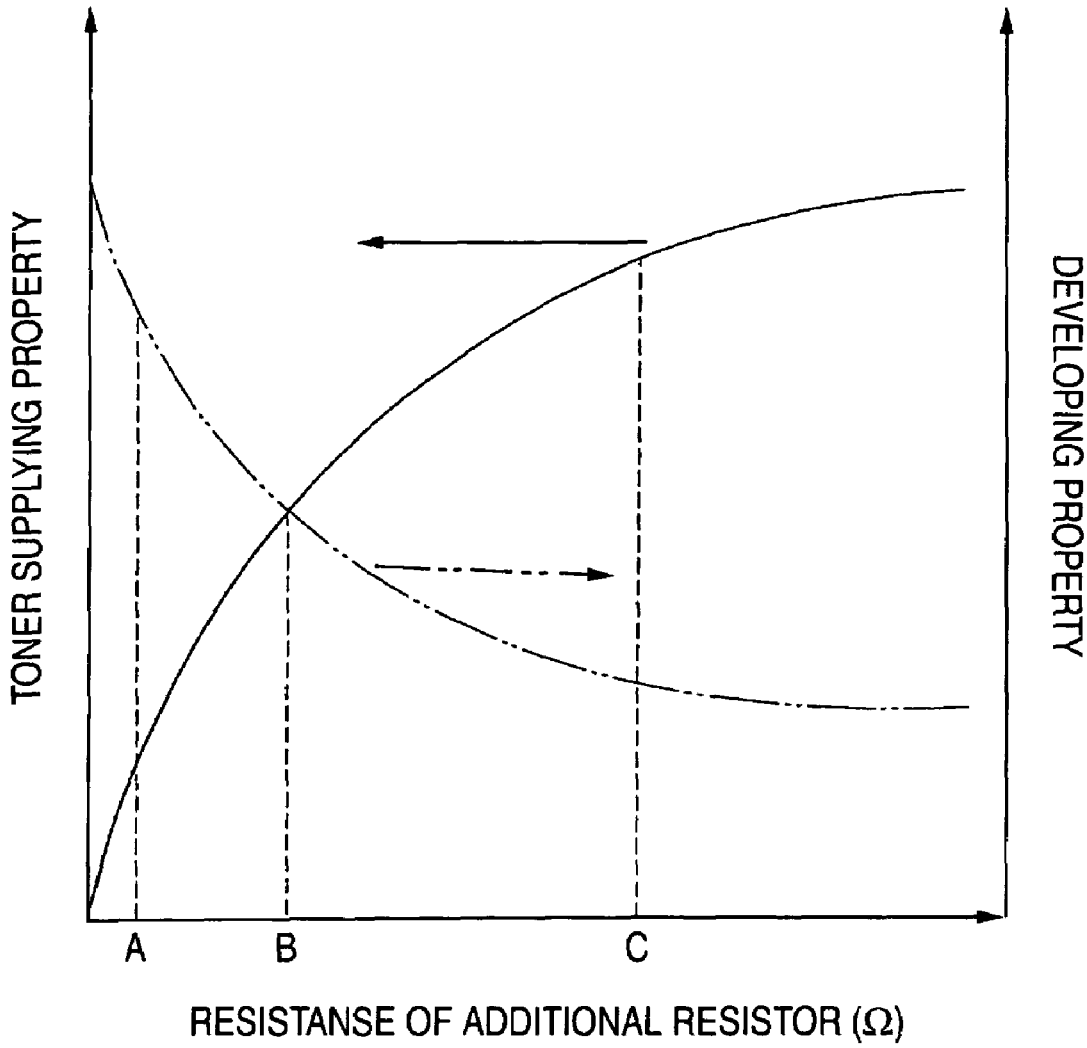
FIG. 4 is a graph showing a correlation between the developing property and the supplying property in connection with a resistance value of an additional resistor in the developing device of the invention.

FIG. 4 shows a correlation between the developing property and the toner supplying property. It has been explained that the current flowing to the second current path 39 is increased by providing the additional resistor 35, which in turn increases a quality of negatively charged toner supplied from the supply roller 13 to the developing roller 15. Because a quantity of toner supplied to the developing roller 15 increases as the resistance value of the additional resistor 35 becomes higher, a quantity of supplied toner shapes an upward-sloping curve as is indicated by a solid line in this figure. On the other hand, when the resistance value of the additional resistor 35 increases, an overall resistance value of the equivalent circuit shown in FIGS. 2A and 2B becomes larger, which reduces a quantity of the current flowing from the photosensitive drum 17 to the developing roller 15. A quantity of toner supplied from the developing roller 15 to the photosensitive drum 17 is thus reduced. Accordingly, the developing property is lowered as is indicated by a dashed chain line in this figure.

Figure 5:
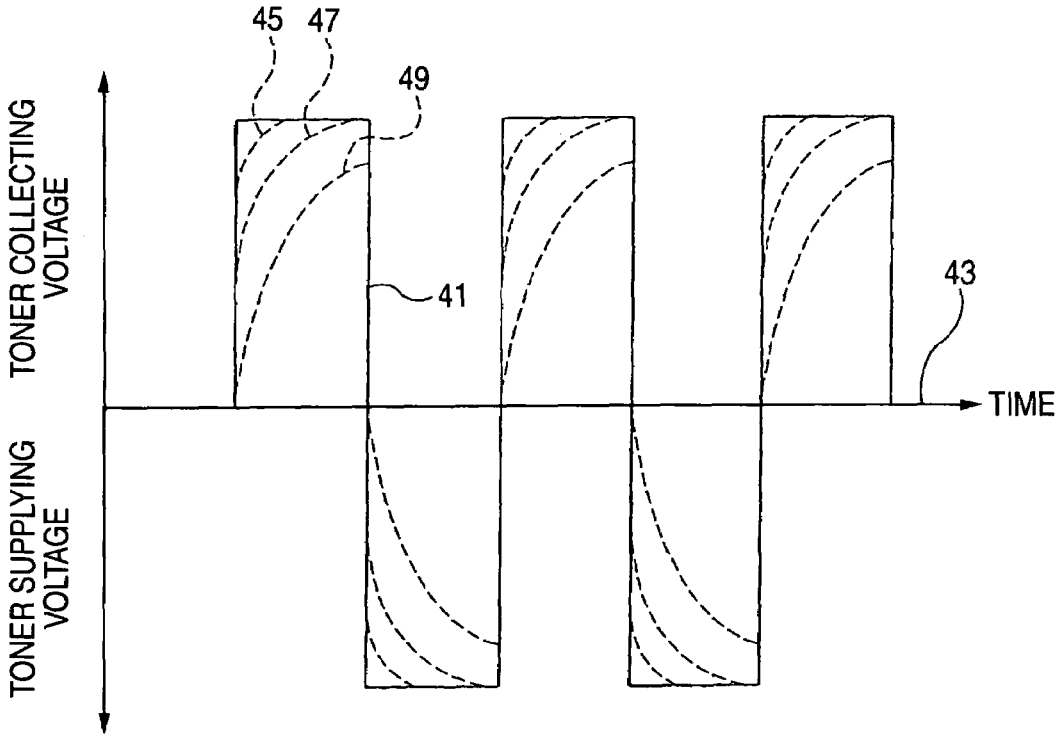
FIG. 5 is a graph showing a change in a developing bias voltage in connection with the resistance value of the additional resistor.

FIG. 5 shows waveforms that represent a change in voltage, indicating how a developing bias varies in response to the resistance value of the additional resistor 35. In this figure, a solid line 41 indicates a case where the additional resistor 35 is not provided. In the bias voltage having an alternating rectangular waveform, the section upper than a reference line 43 serves to collect toner from the photosensitive drum 17 to the developing roller 15, and the section lower than the reference line 43 serves to supply toner from the developing roller 15 to the photosensitive drum 17. Dashed lines 45, 47, and 49 are waveforms when the resistance value of the additional resistor 35 is increased in this order. It appears that a portion that the absolute value of the bias voltage increases becomes dull in accordance with the increase of the resistance value of the additional resistor 35.

FIG. 6A shows changes of the voltages $V_E$, $V_S$, and $V_D$, when the resistance value of the additional resistor 35 is a relatively high value (100 MΩ; C in FIG. 4). In this figure, a solid line 51 denotes a change of the voltage $V_E$, a dashed line 53 denotes a change of the voltage $V_S$, and a chain line 55 denotes a change of the voltage $V_D$. It should be noted that the graph extends long below the line specifying a zero voltage because the negative DC bias voltage (toner supplying voltage) is constantly applied by the use of the bias power supply 27.

FIG. 6B shows a change of the value $(V_S-V_D)$ of FIG. 6A. This value indicates a difference between a voltage on the surface of the supply roller 13 and a voltage of the core material of the developing roller 15. Because it is equivalent to a bias difference applied to the supply roller 13 and the developing roller 15, it means a change in the toner supplying property from the supply roller 13 to the developing roller 15.

FIG. 6C shows an average voltage and a maximum value of the amplitude of $V_D$ obtained from waveforms similar to those of FIGS. 6A and 6B, when the resistance value of the additional resistor 35 is varied in the developing device shown in FIG. 2A. In FIGS. 6A and 6B showing a case where the resistance value of the additional resistor 35 is 10 MΩ, the average voltage value "−460 V" is found from an average of the value $(V_S-V_D)$ in regions indicated by a capital P of FIG. 6B. The maximum value of the amplitude of $V_D$ "571 V" is found from a difference between the top peak and the bottom peak in the leftmost alternation of the chain line 55. Waveforms corresponding to FIG. 6A and FIG. 6B in a case where the resistance value of the additional resistor 35*s* are 10 KΩ, 100 KΩ, and 1 MΩ are omitted. However, the average voltage and the maximum value of the amplitude of $V_D$ in these cases can be found in the same manner, which are set forth in FIG. 6C.

It appears that a voltage difference between the supply roller 13 and the developing roller 15 becomes larger as the absolute value of the average voltage value of $(V_S-V_D)$ becomes higher, and hence the toner supplying property is enhanced. Meanwhile, when the maximum value of the amplitude of $V_D$ becomes higher, toner flies over from the developing roller 15 to the photosensitive drum 17 in a larger quantity, and hence the developing property is enhanced.

Figure 7:
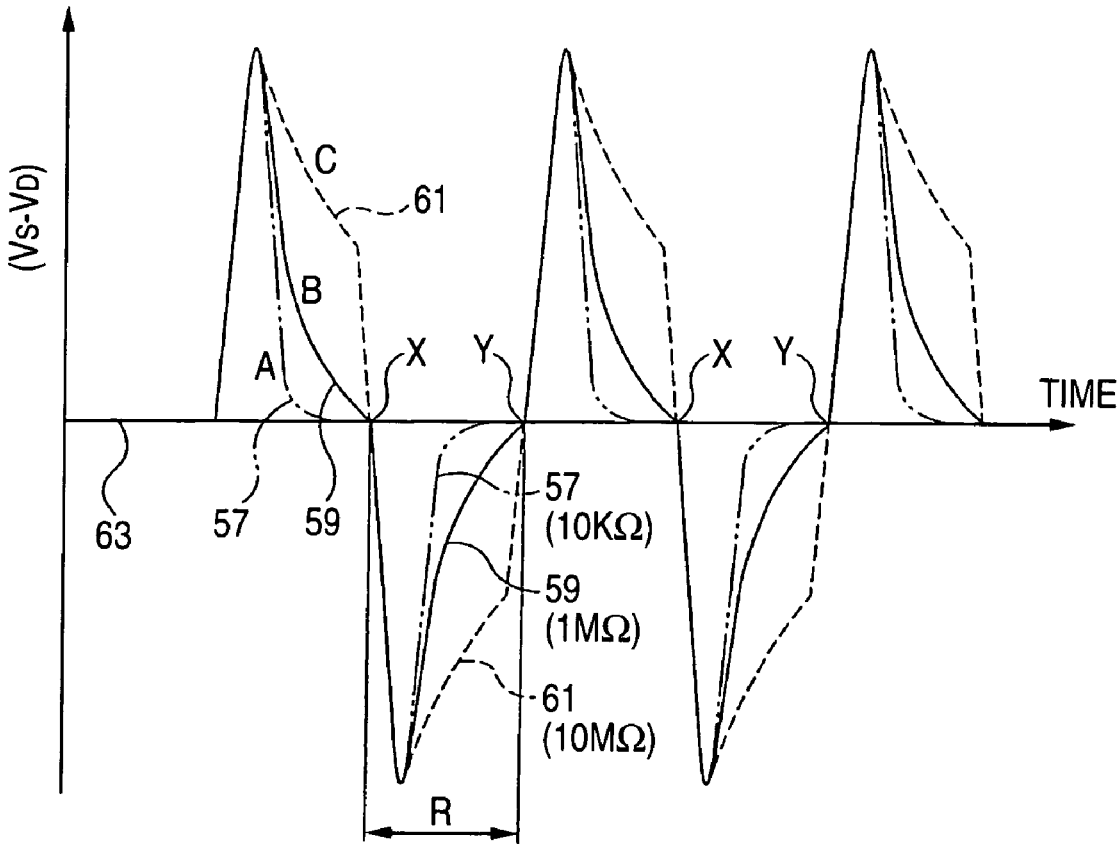
FIG. 7 is a graph showing the changes in the potential difference between the supply roller and the developing roller in the developing device of the invention, in connection with the resistance value of the additional resistor.

FIG. 7 shows, in the same manner as FIG. 6, changes of the value ($V_S$–$V_D$) in all cases of FIG. 4 where the resistance value of the additional resistor 35 is a relatively low value (A: 10 KΩ; dashed chain line 57), an intermediate value (B: 1 MΩ; solid line 59), and a relatively high value (C: 10 MΩ; dashed line 61).

Figure 8A:
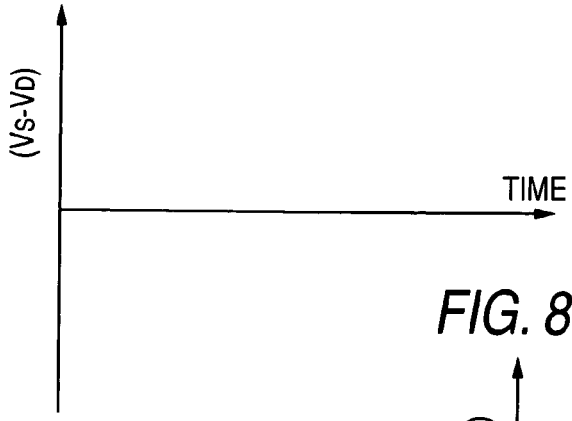
FIG. 8A is a graph showing a change in the potential difference between the supply roller and the developing roller in the developing device of the invention, in a case where no additional resistor is provided.
Figure 8B:
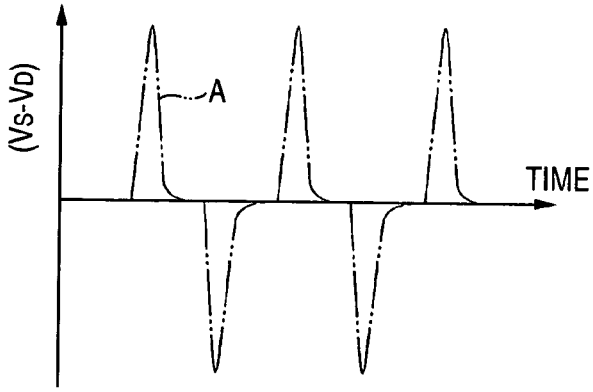
FIG. 8B is a graph showing a change in the potential difference between the supply roller and the developing roller in the developing device of the invention, in a case where the resistance value of the additional resistor is relatively low.
Figure 8C:
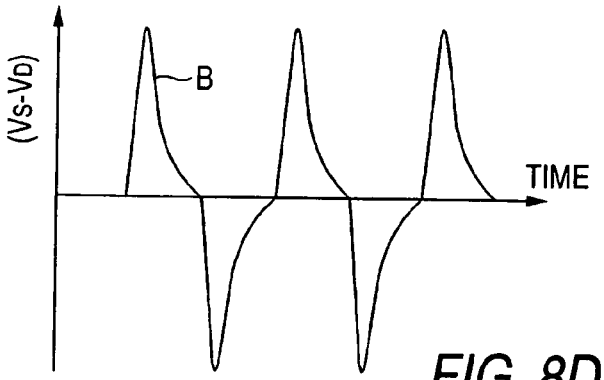
FIG. 8C is a graph showing a change in the potential difference between the supply roller and the developing roller in the developing device of the invention, in a case where the resistance value of the additional resistor is adequate.
Figure 8D:
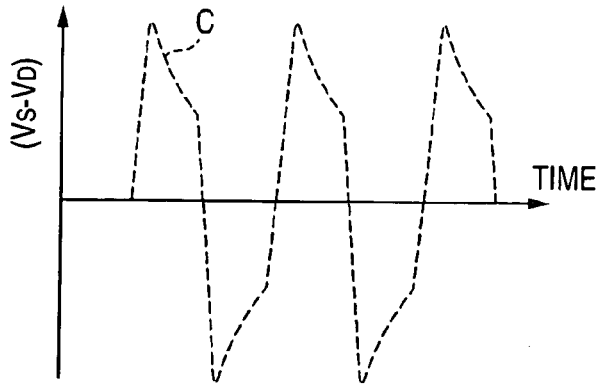
FIG. 8D is a graph showing a change in the potential difference between the supply roller and the developing roller in the developing device of the invention, in a case where the resistance value of the additional resistor is relatively high.

FIGS. 8A through 8D separately show each of the graphs combined in FIG. 7. FIG. 8A shows a change of the value ($V_S$–$V_D$) in a case where the resistance value of the additional resistor 35 is zero, that is, when there is no potential difference between the supply roller 13 and the developing roller 15. FIG. 8B shows a case where the resistance value of the additional resistor 35 is a relatively small value A, that is, when a potential difference between the supply roller 13 and the developing roller 15 is relatively small. FIG. 8C shows a case where the resistance value of the additional resistor 35 is an adequate value B, that is, when a potential difference between the supply roller 13 and the developing roller 15 is adequate. FIG. 8D shows a case where the resistance value of the additional resistor 35 is a relatively high value C, that is, when a potential difference between the supply roller 13 and the developing roller 15 is excessive.

In the waveform shown in FIG. 7, the section lower than a reference line 63 shows a change of the potential difference ($V_S$–$V_D$) when the toner 11 flies over from the developing roller 15 to the photosensitive drum 17 (i.e., at the time of development). Accordingly, a time period R between points X and Y corresponding to one cycle of the potential difference change represents a time period that the developing voltage is applied.

Referring to FIG. 6C, the maximum value of the amplitude of $V_D$ in a case where the resistance value of the additional resistor 35 is 1 MΩ or less is a value sufficiently large for the development to take place. In a case where the resistance value of the additional resistor 35 is 100 KΩ or more, the toner supplying property is sufficiently high, but in a case where the resistance value of the additional resistor 35 is 10 KΩ, the supplying property does not necessarily reach a sufficient value. Even in a case where the resistance value of the additional resistor 35 is 10 KΩ, however, it is obvious that the supplying property is higher than in a case where no additional resistor is provided. Hence, when additional resistor of 1 MΩ or less is provided, both the supplying property and the developing property are enhanced.

When the data result of FIG. 6C is compared with the graph of FIG. 7, it is understood that both the supplying property and the developing property are enhanced by providing, between the branching point E and the developing roller 15, the additional resistor 35 having such a resistance value that the potential difference between the supply roller 13 and the developing roller 15 converges on the reference value 63 (e.g., zero) within the time period R during which the developing voltage is applied. It should be noted that the resistance value of the additional resistor 35 is not necessarily limited to those specified above if the toner supplying property is to be enhanced without giving much importance to the developing property, because the toner supplying property from the supply roller 13 to the developing roller 15 is enhanced by providing the additional resistor 35.

The above explanations are applicable to both of the embodiments shown in FIGS. 2A and 2B.

What is claimed is:

1. A developing device, comprising:

an image carrier, on which an electrostatic latent image is formed;

a first roller, opposed to the image carrier with a gap in between;

a second roller, being in contact with the first roller such that toner of a one-component type is supplied onto the image carrier by way of the first roller to develop the electrostatic latent image as a visible toner image;

a single power source, which supplies a bias voltage in which an AC voltage is superposed on a DC bias voltage, the bias voltage being supplied to the first roller through a first path and to the second roller through a second path; and a resistor, provided on the first path between the first roller and a branching point of the first path and the second path, wherein the resistor has such a value that a potential difference between the first roller and the second roller converges on a reference value within a time period during which a potential difference between the first roller and the image carrier is such a value that charged toner is supplied from the first roller to the image carrier.

2. The developing device as set forth in claim 1, wherein a resistance of the second roller is greater than a resistance of the first roller.

3. The developing device as set forth in claim 1, wherein a current flowing through the second path is greater than a current flowing through the first path.

4. The developing device as set forth in claim 1, wherein the power source is a constant-voltage power source.

5. The developing device as set forth in claim 1, wherein the second roller is an electron-conductive roller.

6. The developing device as set forth in claim 1, wherein the reference value is zero.

7. A developing device, comprising:

an image carrier, on which an electrostatic latent image is formed;

a first roller, opposed to the image carrier;

a second roller, being in contact with the first roller such that toner is supplied onto the image carrier by way of the first roller to develop the electrostatic latent image as a visible toner image;

a single power source, which supplies a bias voltage to the first roller through a first path and to the second roller through a second path; and a resistor, provided on the first path between the first roller and a branching point of the first path and the second path, wherein the resistor has such a value that a potential difference between the first roller and the second roller converges on a reference value within a time period during which a potential difference between the first roller and the image carrier is such a value that charged toner is supplied from the first roller to the image carrier.

8. The developing device as set forth in claim 7, wherein the reference value is zero.

* * * * *